US006431689B1

(12) United States Patent
Schippers

(10) Patent No.: US 6,431,689 B1
(45) Date of Patent: Aug. 13, 2002

(54) STRUCTURES INCLUDING MICROVALVES AND METHODS OF FORMING STRUCTURES

(75) Inventor: Michael S. Schippers, Austin, TX (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,628

(22) Filed: Nov. 28, 2000

(51) Int. Cl.[7] ..... B41J 2/05; B41J 2/17
(52) U.S. Cl. ..... 347/65; 347/94
(58) Field of Search ..... 347/63, 65, 67, 347/92, 94, 93; 29/890.1

(56) References Cited

U.S. PATENT DOCUMENTS 5,278,585 A * 1/1994 Karz et al. ..... 347/94
5,872,582 A * 2/1999 Pan ..... 347/65

OTHER PUBLICATIONS

"Formation and Oxidation of Porous Silicon for Silicon on Insulator Technologies"; Energy Beam–Solid Interactions and Transient Thermal Processing, 1985, pp. 463–474.

* cited by examiner

*Primary Examiner*—John Barlow
*Assistant Examiner*—Juanita Stephens
(74) *Attorney, Agent, or Firm*—Oliff & Berridge, PLC

(57) ABSTRACT

A structure includes a first substrate and a second substrate defining a fluid channel. A microvalve is formed on the first or second substrate. The microvalve includes a flap that is flexed by pressure exerted on the flap by the vapor on the fluid in the channel to prevent the fluid from flowing into portions of the channel. The microvalves can be formed in ink jet print heads. The microvalves can be formed in semiconductor materials by simplified methods utilizing a reduced number of masking levels.

21 Claims, 5 Drawing Sheets

STRUCTURES INCLUDING MICROVALVES AND METHODS OF FORMING STRUCTURES

BACKGROUND OF THE INVENTION

1. Field of Invention

This invention relates to structures including microvalves. This invention further relates to methods of forming the structures.

2. Description of Related Art

Known ink jet print heads include a heater wafer, a channel wafer and an ink reservoir. Ink channels and nozzles are formed in the ink jet print heads for flowing and discharging ink onto recording media. Heating elements are provided in the ink channels to heat the ink and cause ink droplets to be discharged out of the nozzles and onto recording media.

SUMMARY OF THE INVENTION

FIG. 1 illustrates a known ink jet print head 10 structure. The ink jet print head 10 comprises a device wafer (or heater wafer) 12 and a channel wafer 14 over the device wafer 12. A bonding layer 15 is formed between the device wafer 12 and channel wafer 14. An ink reservoir 16 contains a supply of ink. The ink is supplied from the ink reservoir 16 to a plurality of ink channels forming nozzles. A single ink channel 18 is shown for simplicity. The ink channel 18 extends to the front face 20 of the ink jet print head 10. A heating element, such as the heating element 22, is formed on the top surface 24 of the device wafer 12 for each ink channel 18. The heating element 22 is powered to heat the ink in the ink channel 18. Heating of the ink by the heating element 22 forms vapor bubbles in the ink channel 18. A vapor bubble 26 is shown formed over the heating element 22. The vapor bubble 26 pushes ink through the ink channel 18 in the direction toward the front face 20. The ink is ejected as ink droplets 28 onto a recording medium (not shown).

The vapor bubble 26 formed by heating the ink in the ink channel 18 also pushes ink through the ink channel 18 in the direction toward the ink reservoir 16. Gas bubbles 30 formed by heating the ink can also flow back into the ink reservoir 16. The gas bubbles 30 can agglomerate and grow in the ink reservoir 16 to a point at which the gas bubbles 30 affect the printing performance of the ink jet print head 10.

This invention provides structures including microvalves that can be used in various devices that comprise fluid channels to control fluid flow in the fluid channels. Structures that can be formed according to this invention can be used, for example, in ink jet print heads to overcome the above-described problems of known ink jet print heads, such as those described above for the ink jet print head 10.

This invention separately provides ink jet print heads including microvalves.

This invention also separately provides methods of forming structures including microvalves.

This invention also separately provides methods of forming ink jet print heads including microvalves.

Exemplary embodiments of structures according to this invention comprise a first substrate and a second substrate defining a fluid channel. The fluid channel includes a first channel portion and a second channel portion. A heating element is provided in the first channel portion. The heating element heats fluid disposed in the first channel portion to form vapor. A microvalve is formed on one of the first substrate and the second substrate. The microvalve includes a flap that is flexed by pressure exerted on the flap by the vapor on the fluid to at least substantially prevent, or even completely prevent, the fluid from flowing from the first channel portion into the second channel portion.

The structure can be, for example, an ink jet print head. The microvalve can at least substantially prevent, or even completely prevent, gas (from bubble nucleation) from flowing into the ink reservoir and affecting printing performance.

Exemplary embodiments of methods of forming the structures according to this invention comprise forming a thermal oxide over a silicon substrate; forming an opening through the thermal oxide; doping the silicon substrate with boron via the opening in the thermal oxide to form a boron-doped region in the silicon substrate; forming an n-type dopant region in the boron-doped region; etching the boron-doped region to form porous silicon; oxidizing the porous silicon to form silicon dioxide; and etching the silicon dioxide to form a channel in the silicon substrate. The n-type dopant region forms a flap of the microvalve.

BRIEF DESCRIPTION OF THE DRAWINGS

Preferred embodiments of this invention will be described in detail, with reference to the following figures, in which.

DETAILED DESCRIPTION OF PREFERRED EMBODIMENTS

This invention provides structures that can be used in devices that comprise fluid channels to control fluid flow in the channels. The structures according to this invention include microvalves. The microvalves can be used in various devices to control the flow of fluids in fluid channels.

This invention provides devices that include fluid channels and microvalves to control fluid flow in the fluid channels. The devices can be, for example, ink jet print heads.

This invention also provides methods of forming microvalves. The methods can be used to form microvalves in a simplified manner. This invention also provides methods of forming devices including microvalves, such as ink jet print heads.

Figure 1:
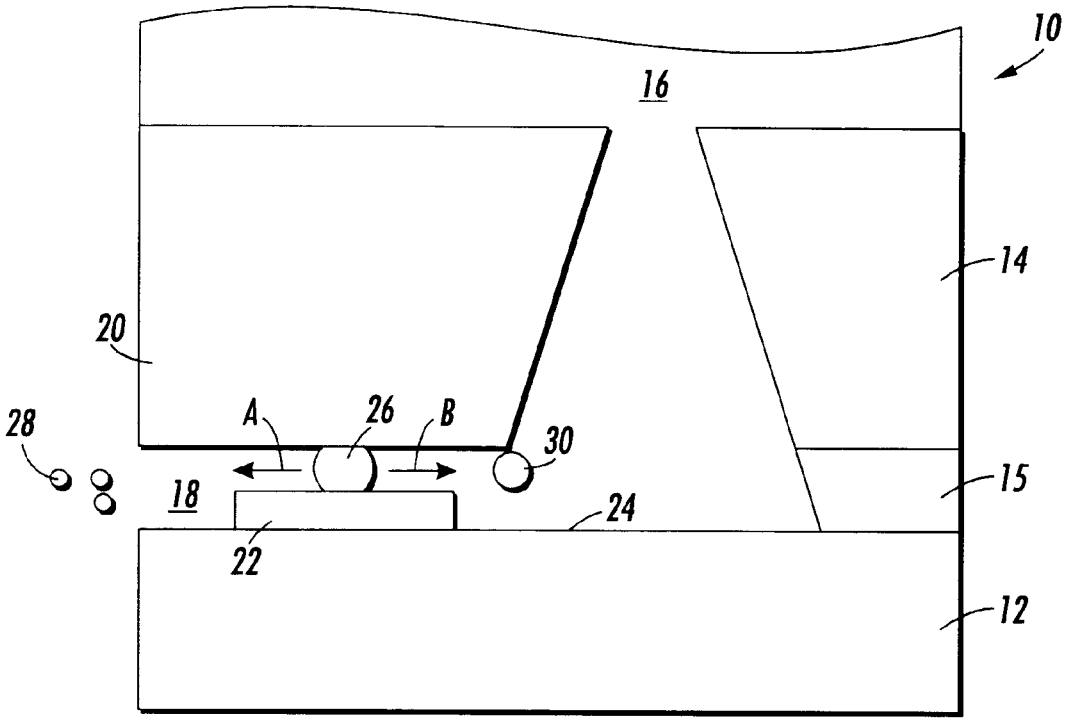
FIG. 1 RELATED ART
FIG. 1 is an illustrational view showing a portion of a known ink jet print head.
Figure 2:
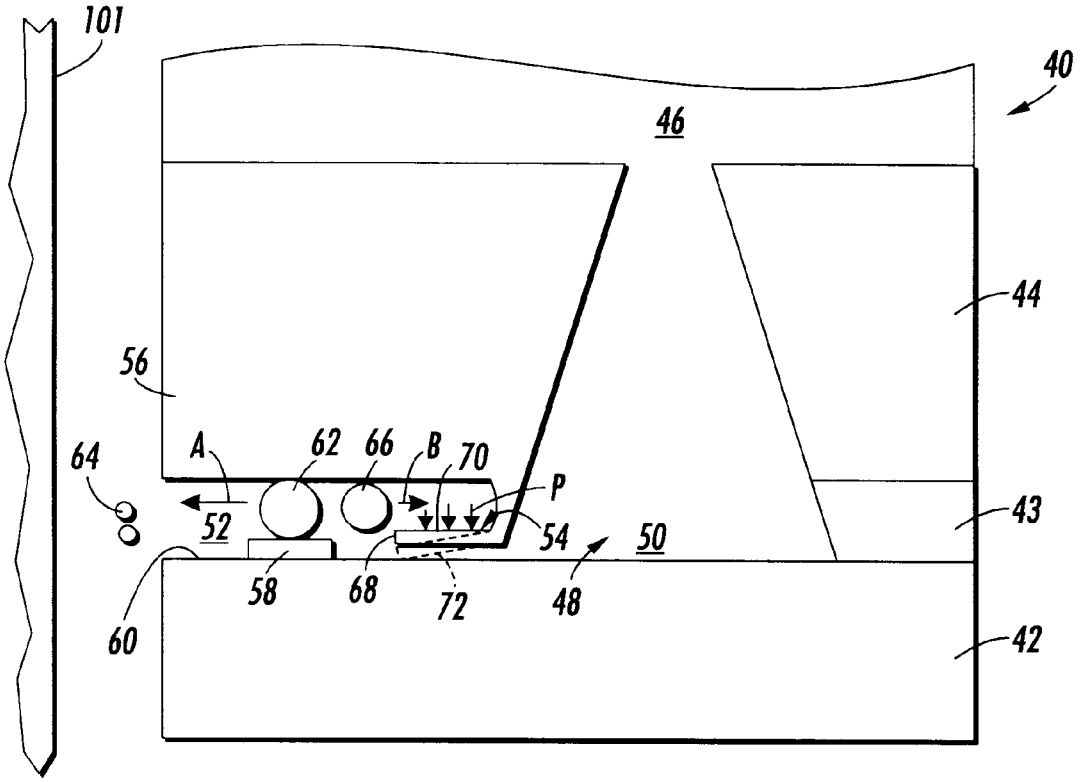
FIG. 2 is an illustrational view showing a portion of an exemplary ink jet print head including a microvalve according to this invention.

FIG. 2 shows an exemplary embodiment of an ink jet print head 40 according to this invention. The ink jet print head 40 comprises a device wafer (or heater wafer) 42 and a channel wafer 44. The device wafer 42 and channel wafer 44 are joined together by a suitable material 43, such as any suitable adhesive. Anodic bonding can also be used. The device wafer 42 can be formed of any suitable material. Typically, the device wafer is composed of silicon. The channel wafer 44 can also be formed of any suitable material. Typically, the channel wafer 44 is formed of silicon.

The ink print head 40 also comprises an ink reservoir 46. The ink reservoir 46 contains a supply of liquid ink that is flowed to ink channels formed in the ink jet print head 40. A single ink channel 48 is shown for simplicity. The ink channel 48 includes a lower ink channel 50 and an upper ink channel 52. The lower ink channel 50 extends from the ink reservoir 46 to a microvalve 54, which separates the upper ink channel 52 from the lower ink channel 50. The upper ink channel 52 extends from the microvalve 54 to the front face 56 of the ink jet print head 40.

A heating element 58 is formed on the top surface 60 of the device wafer 42 for each upper ink channel 52 of the inkjet print head 40. The heating element 58 can be any suitable heating element, such as, for example, a polysilicon resistor. The heating element 58 is selectively powered by an electrical power source to heat ink contained in the upper ink channel 52. Heating of the ink forms vapor bubbles in the upper ink channel 52, such as the vapor bubble 62 formed over the heating element 58. The vapor bubble 62 exerts pressure on the ink in the upper ink channel 52. This pressure pushes ink in the direction A through the upper ink channel 52 and toward the front face 56. Ink droplets 64 are ejected from the upper ink channel 52 via a nozzle onto a recording medium 101.

The vapor bubble 62 formed by heating ink in the upper ink channel 52 also pushes ink in the direction B through the upper ink channel 52 and toward the microvalve 54. Gas bubbles, such as gas bubbles 66, also form in the upper ink channel 52 by heating of the ink. These gas bubbles 66 occur due to changes in the solubility of the ink as the ink is heated. These gas bubbles 66 can also flow in the direction B toward the microvalve 54.

The microvalve 54 is formed in the ink jet print head 40 to prevent the vapor bubbles or gas bubbles 66 from flowing back into the ink reservoir 46 and affecting the printing performance of the ink jet print head 40. In the ink jet print head 40, the microvalve 54 is formed on the channel wafer 44. However, in other embodiments of ink jet print heads according to this invention, microvalves can alternatively be formed on the device wafer 42. The microvalve 54 includes a flap 68. The flap 68 is shown in solid line in an open position. The action of the vapor on the ink exerts pressure P on the upper face 70 of the flap 68. The flap 68 has sufficient flexibility such that pressure generated by the vapor and ink on the flap causes the flap to flex downwards in the direction toward the top surface 60 of the heater wafer 42, as depicted in dotted line. This pressure causes the bottom face 72 of the flap 68 to close sufficiently to, or to even make contact with, the top surface 60 of the device wafer 42, which significantly reduces, or even closes, the opening between the flap 68 and top surface 60. Contact between the flap 68 and top surface 60 forms a fluid seal that closes off the upper ink channel 52 from the lower ink channel 50, and thus prevents the gas bubbles 66 from flowing from the upper ink channel 52 into the ink reservoir 46. Also, partial movement of the flap 68 results in a reduction in the opening area, that also effectively closes off the upper ink channel 52 from the lower ink channel 50. Consequently, this movement of the flap 68 reducing the opening area at least substantially prevents ink flow into the lower ink channel 50. When the flap 68 is in the closed position, ink is prevented from flowing from the upper ink channel 52 into the lower ink channel 50. Consequently, problems associated with the agglomeration of gas bubbles in the ink reservoir 46 can be at least substantially reduced, and preferably are prevented, by the provision of the microvalve 54.

The lower ink channel 50 is formed in the device wafer 42 to enable ink to flow more easily from the ink reservoir 46 to refill the upper ink channel 52 following the ejection of ink from the upper ink channel onto recording media.

Figure 3:
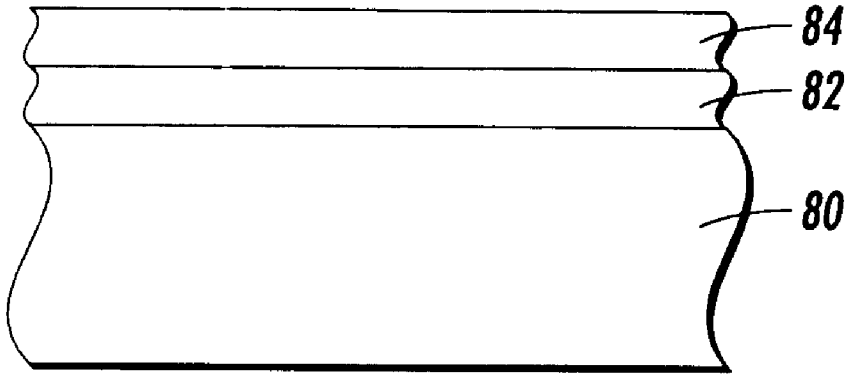
FIGS. 3–9 illustrate an exemplary process of forming structures including a microvalve according to this invention.

An exemplary embodiment of the methods of forming microvalves 54 according to this invention is illustrated in FIGS. 3–9. In this embodiment, the substrate 80 is composed of silicon. The silicon can be either single crystal silicon or polysilicon. As shown in FIG. 3, a thermal oxide layer 82 is initially formed on the silicon substrate 80. The thermal oxide layer 82 can be formed by any suitable process. For example, the thermal oxide layer 82 can be formed by direct oxidation at a suitable elevated temperature in an oxygen-containing atmosphere, such as in an oxygen or steam ambient.

A photoresist layer 84 is formed over the thermal oxide layer 82. The photoresist layer 84 can comprise either a positive resist composition or a negative resist composition. The photoresist layer 84 can be formed over the thermal oxide layer 82 by any suitable technique, such as by spin coating. After the photoresist layer 84 is formed, it is exposed using any suitable light source. The exposed photoresist layer 84 may then be subjected to a post-exposure bake to stabilize the reaction that keeps the pattern in the polymeric layer.

The patterned photoresist layer 84 is developed using any suitable chemical for developing the particular positive or negative photoresist composition.

Figure 4:
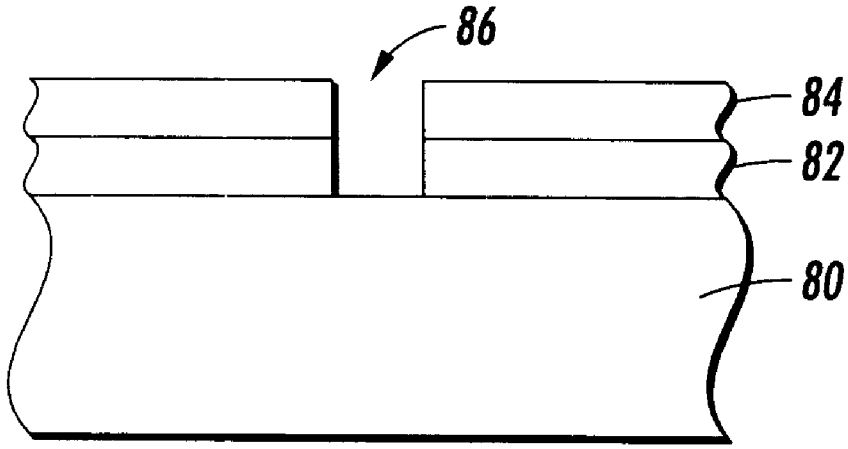

As shown in FIG. 4, the thermal oxide layer 82 is next patterned. The thermal oxide layer 82 can be patterned by any suitable etching process. The etching process may be, for example, any suitable dry etching process. Plasma etching is advantageous in embodiments in which enhanced anisotropic etching characterized by reduced lateral undercutting is desired to form certain opening geometries in the thermal oxide layer 82.

The etching process may alternatively be any suitable wet etching process. For example, the wet etching process can utilize a wet etchant, such as HF, to etch the thermal oxide layer 82.

Openings 86 are formed in the thermal oxide layer 82 by etching. The openings 86 extend through the thermal oxide layer 82 to the silicon substrate 80. The etching process selectively etches the thermal oxide layer 82 and removes only an inconsequential amount of the silicon substrate 80.

The photoresist layer 84 is stripped from the thermal oxide layer 82 by any suitable process. For example, the photoresist layer 84 can be stripped using any suitable stripping solution, such as acid solutions and organic solvents. The photoresist layer 84 can also be stripped by dry processes, such as by plasma etching in an oxygen atmosphere.

Figure 5:
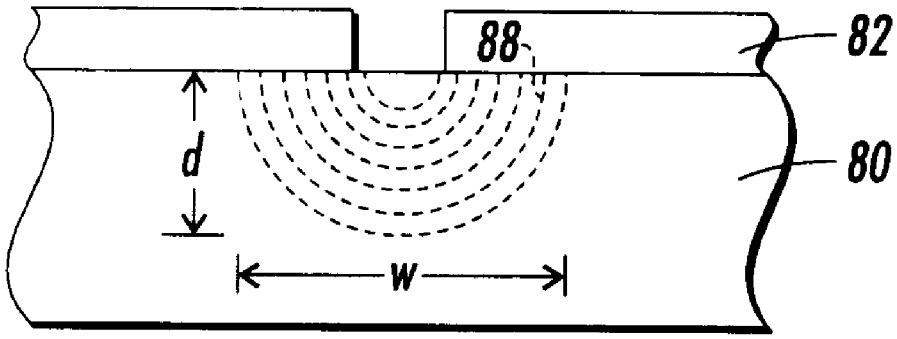

As shown in FIG. 5, the thermal oxide layer 82 is a masking layer for the doping of the silicon substrate 80. In embodiments, boron is doped into the silicon substrate 80. Boron can be doped by a solid state diffusion process into the silicon substrate 80. For example, the solid state diffusion process can comprise depositing a solid boron source on the silicon substrate 80. For example, a spin-on-glass containing boron can be formed on the silicon substrate.

The boron diffusion process is conducted at temperatures and for amounts of time effective to form the desired boron diffusion profile in the silicon substrate 80 and form the boron-doped region 88.

Boron can alternatively be introduced into the silicon substrate 80 by any suitable implantation technique.

The boron doping process forms a boron-doped region 88 in the silicon substrate 80. The boron doped region 88 is subsequently removed to define a channel region in the silicon substrate 80, as described below.

The boron-doped region 88 typically has a depth, d, of from about 1 micron to about 100 microns, and a width, w, of from about 1 micron to about 100 micron.

The boron-doped region can typically have a boron concentration of from about $1\times10^{14}$ to about $1\times10^{18}$ atoms/cm$^3$.

The boron-doped region 88 can have an isometric or substantially isometric profile as shown in FIG. 5. However, in other embodiments, the profile of the boron-doped region in the silicon substrate 80 can be non-isometric. For example, as shown in FIG. 6, a non-isometric boron-doped region 90 can be formed by a combination of solid state diffusion and etching processes, such as ion etching processes, which also forms trenches in the silicon substrate 80.

Figure 6:
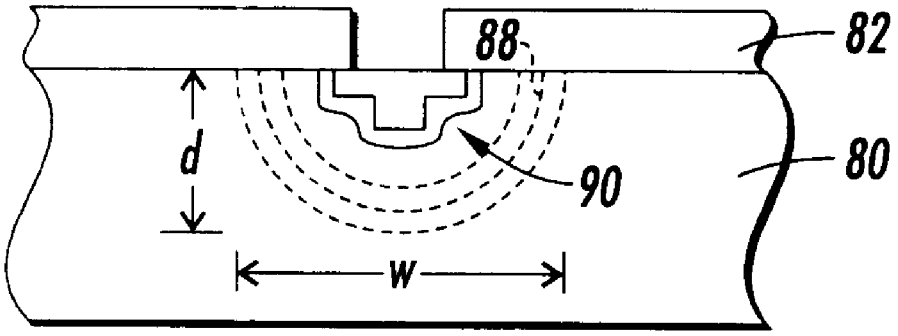

Those having ordinary skill in the art will understand that other isometric and non-isometric boron concentration profiles than those shown in FIGS. 5 and 6 can be formed in the silicon substrate 80, depending on the desired channel configuration to be formed in the silicon substrate 80.

Figure 7:
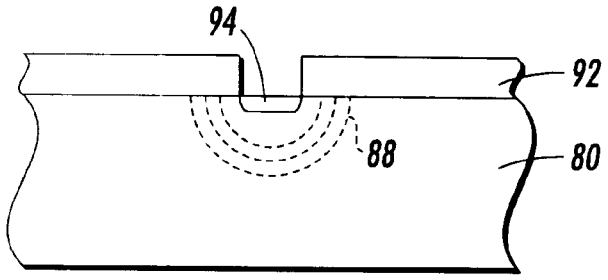
Figure 8:
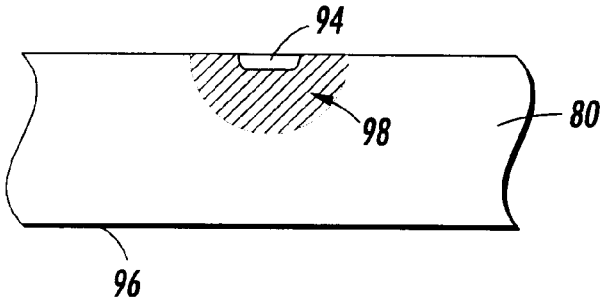
Figure 9:
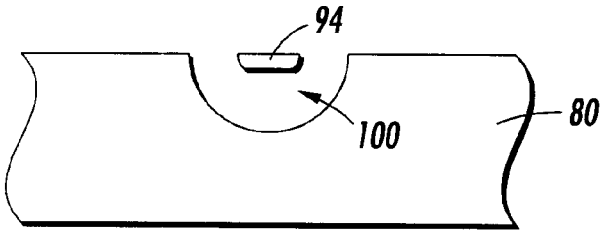

Referring to FIG. 7, next, the thermal oxide layer 82 is stripped from the silicon substrate 80. As stated above, the thermal oxide layer 82 can be removed by any suitable etching process. For example, the thermal oxide layer 82 can be removed by using a wet etching solution such as HF.

After the thermal oxide layer 82 is stripped from the silicon substrate 80, a second photoresist layer 92 is formed on the silicon substrate 80. The photoresist layer 92 can be formed by any of the same processes described above for the photoresist layer 84.

Embodiments of methods of forming microvalves according to this invention need apply only the first photoresist layer 84 and the second photoresist layer 92. That is, embodiments of the methods according to this invention can include only two masking levels. By using only two masking levels, the methods are simplified as compared to methods that utilize a greater number of masking levels.

Next, the photoresist layer 92 is exposed (patterned) to define the flaps of the microvalves.

A suitable material is then introduced into regions 94 of the silicon substrate 80 to define the flaps of the microvalves. The material can be introduced into the silicon substrate 80 lattice by any suitable method. For example, the material can be doped by a solid state diffusion process. Preferably, the material is implanted by a suitable implantation process. Implantation is advantageous because it enables material to be introduced into the silicon substrate 80 to form regions 94 having a selected configuration. The material introduced into the silicon substrate 80 to form the regions 94 can be any suitable material that is an n-type dopant in silicon. A preferred n-type dopant is phosphorous.

After the regions 94 are formed in the silicon substrate, the photoresist layer 92 is stripped from the silicon substrate 80. The photoresist layer 92 can be stripped by the same processes as described above for the photoresist layer 84.

After the n-type dopant material is implanted into the silicon substrate 80 to form n-doped regions 94, the silicon substrate 80 is typically heated to a suitable elevated temperature to anneal the structure and to activate the dopant and convert portions of the silicon substrate 80, that are converted to non-crystalline material by the implantation process, back to crystalline material.

The structure is then etched in a suitable etching solution to form porous silicon in the boron-doped region of the silicon substrate 80. First, the backside 96 of the silicon substrate 80 is coated with a suitable contact material that has good electrical conductivity for electrochemical etching processes. An exemplary suitable contact material is aluminum. Aluminum can be applied on the backside 96 of the silicon substrate to form an electrical contact by any suitable process such as evaporation, physical vapor deposition or chemical vapor deposition.

The silicon substrate 80 is then subjected to wet etching in a suitable solution to form porous silicon in the silicon substrate in the boron-doped region. For example, the solution can be an HF solution. This etching process is selective with respect to the porous silicon region and does not significantly etch the n-doped regions 94.

Next, the aluminum is stripped from the backside of the silicon substrate 80.

The silicon substrate 80 is then oxidized to convert the porous silicon into thermal $SiO_2$ 98. The silicon substrate 80 can be oxidized to form thermal $SiO_2$ 98 by any suitable oxidation process. For example, the porous silicon can be converted to thermal $SiO_2$ 98 by direct oxidation at a suitable elevated temperature in an oxygen-containing atmosphere, such as in an oxygen or steam ambient.

The silicon substrate 80 is then subjected to an etching process to remove the thermal $SiO_2$ 98. For example, the thermal $SiO_2$ 98 can be removed using an HF etching process. By removing the thermal $SiO_2$, channels 100 are formed in the silicon substrate 80.

In embodiments in which the channels 100 are formed in ink jet print heads, such as the ink jet print head 40, the channels partially form the upper channel portion 52.

The channels 100 have a semi-circular shape, substantially as defined by the shape of the boron-doped region 88. However, it will be understood by those having ordinary skill in the art that channels can be formed having various other shapes, as well. For example, the channels 100 can be oval shaped, triangular shaped or any other suitable shape for flowing a fluid through the channel.

The channels typically have a width of from about 1 to about 100 microns and a depth of from about 1 to about 100 microns.

The n-doped regions 94 are not removed by the etching process used to remove the thermal $SiO_2$. The n-doped regions 94 form flaps in the microvalves, such as the microvalve 54 shown in FIG. 2.

Typically, the etching step using an HF etch to remove the thermal $SiO_2$ 98 is followed by a dip with $H_2SO_4/H_2O_2$. This dip can be followed by a rinse using deionized water. A heated methanol rinse can also be used. The dip removes any organic materials and/or contaminants that water may attach to. Consequently, any deformation of the flap of the microvalve caused by water can be prevented.

The microvalves according to this invention have been described above with respect to use in thermal ink jet print heads. However, it will be understood by those skilled in the art that the microvalves can be formed in other types of ink jet print heads such as acoustic ink jet print heads, piezoelectric printheads, and other heads that eject materials (liquid/solid blends/mixtures/combinations, solids that are in liquid phase when ejected, and the like).

Moreover, the microvalves according to this invention can be formed in various other structures that include substrates and flow channels formed in the structures, in order to control the flow of fluids in the flow channels. The substrates can be semiconductor substrates.

While the invention has been described in conjunction with the specific embodiments described above, it is evident that many alternatives, modifications and variations are apparent to those skilled in the art. Accordingly, preferred embodiments of the invention as set forth above are intended to be illustrative and not limiting. Various changes can be made without departing from the spirit and scope of the invention.

What is claimed is:

1. A structure, comprising:

a first substrate;

a second substrate;

a fluid channel defined by the first substrate and second substrate, the fluid channel including a first channel portion and a second channel portion;

a heating element disposed to heat fluid in the first channel portion to form vapor;

a microvalve formed in one of the first substrate and the second substrate, the microvalve including a flap that is flexed downward by pressure exerted on an upper face of the flap by the vapor on the fluid to at least substantially prevent the fluid from flowing from the first channel portion into the second channel portion.

2. The structure of claim 1, wherein the first substrate and the second substrate each comprise silicon.

3. The structure of claim 1, wherein the fluid is liquid ink, the structure further comprises a fluid reservoir that contains the liquid ink, and the microvalve prevents gas formed by bubble nucleation in the first channel portion from flowing from the first channel portion into the fluid reservoir.

4. The structure of claim 1, wherein the microvalve is formed by a method including:

forming a thermal oxide over the one of the first and second substrate;

forming an opening through the thermal oxide;

doping boron into the silicon substrate via the opening in the thermal oxide to form a boron-doped region in the one of the first and second substrate;

forming an n-type dopant region in the boron-doped region;

then etching the boron-doped region to form porous silicon;

oxidizing the porous silicon to form silicon dioxide; and etching the silicon dioxide to form a channel in the one of the first and second substrate, the n-type dopant region forming the flap of the microvalve.

5. An ink jet print head, comprising:

a heater wafer;

a channel wafer;

a fluid channel defined by the heater wafer and the channel wafer, the fluid channel including a first channel portion and a second channel portion;

a heating element disposed to heat ink in the first channel portion to form vapor;

a microvalve formed in one of the heater wafer and the channel wafer, the microvalve including a flap that is flexed downward by pressure exerted on an upper face of the flap by the vapor on the ink to at least substantially prevent the ink from flowing from the first channel portion into the second channel portion.

6. The ink jet print head of claim 5, wherein the device wafer and the channel wafer each comprise silicon.

7. The ink jet print head of claim 5, further comprising an ink reservoir that contains a supply of the ink, and the microvalve prevents gas formed by bubble nucleation in the first channel portion from flowing from the first channel portion into the ink reservoir.

8. The ink jet print head of claim 5, wherein the microvalve is formed by a method, including:

forming a thermal oxide over the one of the heater wafer and the channel wafer;

forming an opening through the thermal oxide;

doping boron into the silicon substrate via the opening in the thermal oxide to form a boron-doped region in the one of the heater wafer and the channel wafer;

forming an n-type dopant region in the boron-doped region;

then etching the boron-doped region to form porous silicon;

oxidizing the porous silicon to form silicon dioxide; and etching the silicon dioxide to form a channel in the one of the heater wafer and the channel wafer, the n-type dopant region forming the flap of the microvalve.

9. A method of applying ink on a recording medium, comprising:

providing the ink jet print head of claim 5;

heating ink in the first channel portion with the heating element to eject ink from the first channel portion onto a recording medium, the heating of the ink forming vapor in the first channel portion, the flap being flexed downward by pressure exerted on an upper face of the flap by the vapor on the ink to at least substantially prevent the ink from flowing from the first channel portion into the second channel portion; and flowing ink into the first channel portion from the second channel portion to replace ink ejected onto the recording medium.

10. A method of making a structure, comprising:

providing a first substrate;

providing a second substrate;

forming a microvalve in one of the first substrate and the second substrate, the microvalve including a flap;

joining the first substrate and second substrate to each other, the first substrate and second substrate defining a fluid channel including a first channel portion and a second channel portion; and forming a heating element that heats fluid disposed in the first channel portion to form vapor;

wherein the flap is flexed downward by pressure exerted on an upper face of the flap by the vapor on the fluid to at least substantially prevent the fluid from flowing from the first channel portion into the second channel portion.

11. The method of claim 10, wherein the first substrate and the second substrate each comprise silicon.

12. The method of claim 11, wherein the microvalve is formed by:

forming a thermal oxide over one of the first substrate and the second substrate;

forming an opening through the thermal oxide;

doping boron into the silicon substrate via the opening in the thermal oxide to form a boron-doped region in the one of the first substrate and the second substrate;

forming an n-type dopant region in the boron-doped region;

the etching the boron-doped region to form porous silicon;

oxidizing the porous silicon to form silicon dioxide; and etching the silicon dioxide to form, a channel in the one of the first substrate and the second substrate, the channel partially forming the first channel portion, and the n-type dopant region forming the flap of the microvalve.

13. The method of claim 12, wherein:

the forming of an opening through the thermal oxide comprises:

forming a first photoresist layer over the thermal oxide; and patterning the first photoresist layer to define the opening; and the forming of an n-type dopant region in the boron-doped region comprises:

removing the thermal oxide over the one of the first substrate and the second substrate;

forming a second photoresist layer over the one of the first substrate and the second substrate; and patterning the second photoresist layer to form an opening through which the n-type dopant is doped into the boron-doped region.

14. The method of claim 12, wherein the boron-doped region is formed by solid state diffusion.

15. The method of claim 12, wherein the boron-doped region is formed by solid state diffusion and etching.

16. The method of claim 12, wherein the n-type dopant region is formed by ion implantation.

17. The method of claim 12, wherein the channel has an isometric shape.

18. The method of claim 12, wherein the channel has a non-isometric shape.

19. The method of claim 12, wherein the channel has a width of from about 1 micron to about 100 microns, and a depth of from about 1 micron to about 100 microns.

20. The method of claim 12, wherein:

the structure is an ink jet print head;

the first substrate is a heater wafer; and the second substrate is a channel wafer.

21. The method of claim 10, wherein the fluid is liquid ink, the structure further comprising a fluid reservoir that contains a supply of the liquid ink, and the microvalve prevents gas formed by bubble nucleation in the first channel portion from flowing from the first channel portion into the fluid reservoir.

* * * * *